US007417200B2

(12) United States Patent
Hsu

(10) Patent No.: US 7,417,200 B2
(45) Date of Patent: Aug. 26, 2008

(54) INPUT DEVICES AND KEY STRUCTURES THEREOF HAVING RESILIENT MECHANISMS

(75) Inventor: Chien-Shih Hsu, Taipei (TW)

(73) Assignee: Darfon Electronics Corp., Taoyuan (TW)

( * ) Notice: Subject to any disclaimer, the term of this patent is extended or adjusted under 35 U.S.C. 154(b) by 301 days.

(21) Appl. No.: 11/336,226

(22) Filed: Jan. 20, 2006

(65) Prior Publication Data

US 2006/0157326 A1 Jul. 20, 2006

(30) Foreign Application Priority Data

Jan. 20, 2005 (TW) ..... 94101652 A

(51) Int. Cl.
*H01H 9/26* (2006.01)
*H01H 13/72* (2006.01)
*H01H 13/76* (2006.01)

(52) U.S. Cl. ..... 200/5 A; 200/344

(58) Field of Classification Search ..... 200/5 A
See application file for complete search history.

(56) References Cited

U.S. PATENT DOCUMENTS 5,466,901 A * 11/1995 Mochizuki ..... 200/5 A
5,735,390 A * 4/1998 Takagi et al. ..... 200/344
6,570,113 B2 * 5/2003 Yu et al. ..... 200/344
7,022,927 B2 * 4/2006 Hsu ..... 200/344
7,345,253 B2 * 3/2008 Hsu ..... 200/344

* cited by examiner

*Primary Examiner*—Lincoln Donovan
*Assistant Examiner*—Lheiren Mae A Anglo
(74) *Attorney, Agent, or Firm*—Quintero Law Office

(57) ABSTRACT

Key structures are provided. A key structure comprises a key cap, a substrate, a resilient unit, a first rod and a second rod. The first and second rods connect the substrate and the key cap. When the resilient unit is in a first position, the resilient unit abuts the first rod and exerts a lateral pre-tension force on the first rod, to hold the key cap at a first height with respect to the substrate, such that the key structure is in a normal state. When the resilient unit moves to a second position, the first rod is released from the resilient unit, and the key cap descends to a second height by gravity or an external force, such that the key structure is in a depressed state.

19 Claims, 23 Drawing Sheets

INPUT DEVICES AND KEY STRUCTURES THEREOF HAVING RESILIENT MECHANISMS

BACKGROUND OF THE INVENTION

1. Field of the Invention

The invention relates in general to key structures and in particular to input devices having elevated key structures for space reduction and enhanced convenience.

2. Description of the Related Art

Referring to FIG. 1A, a conventional key structure can be vertically depressed by moving a slider S in a first direction A. The conventional key structure in FIG. 1*a* primarily comprises a substrate B, a first rod L1, a second rod L2, an elastic dome E, a slider S and a key cap K. The first rod L1 has a first end L11 and a second end L12, and the second rod L2 has a third end L23 and a fourth end L24. The first rod L1 and the second rod L2 are pivotally connected via a hinge P. The first and fourth ends L11 and L24 are movable and pivotally connected to the substrate B and key cap K, respectively. The second and third ends L12 and L23 are pivotally connected to the key cap K and the substrate B, respectively.

As shown in FIGS. 1*a* and 1*b*, when the slider S moves from a first position A1, as shown in FIG. 1A to a second position A2, as shown in FIG. 1B, the slider S impels the first end L11 along the first direction A. The key cap K is therefore depressed from height H to height H', and the key structure is in a depressed state. This conventional key structure is usually employed in a keyboard of a laptop computer. The keyboard can be normally used or miniaturized by shifting the slider S.

When the slider S impels the first rod L1 in first direction A, the key structure descends from the original state shown in FIG. 1A to the depressed state shown in FIG. 1B. However, it can be difficult to depress the key cap K by shifting the slider S because the key cap K inevitably exerts an upward recovery force perpendicular to the substrate B from the compressed elastic dome E. Moreover, the key structure may be in the depressed state as shown in FIG. 1B for a long time, adversely decreasing the utility life of the elastic dome E due to long-term deformation.

BRIEF SUMMARY OF THE INVENTION

Key structures are provided. A Key structure comprises a key cap, a substrate, a resilient unit, a first rod and a second rod. The first and second rods connect the substrate and the key cap. When the resilient unit is in a first position, the resilient unit abuts the first rod and exerts a lateral pre-tension force on the first rod, to hold the key cap at a first height with respect to the substrate, such that the key structure is in a normal state. When the resilient unit moves to a second position, the first rod is released from the resilient unit, and the key cap descends to a second height by gravity or an external force, such that the key structure is in a depressed state.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

Figure 1A:
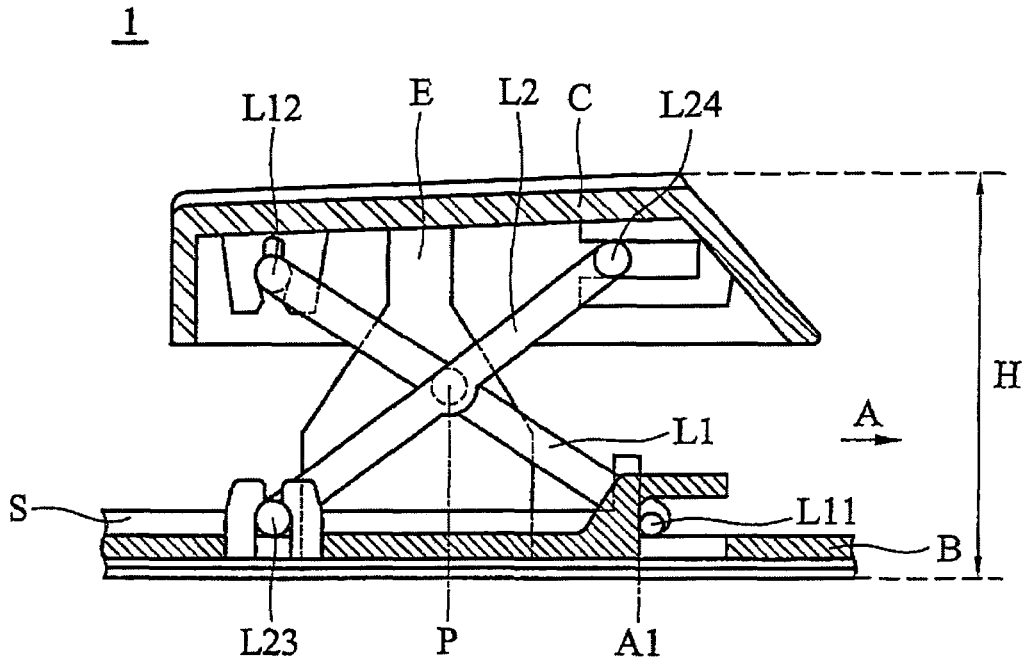
FIG. 1A ( RELATED ART )
FIGS. 1A and 1B are perspective diagrams of a conventional key structure.
Figure 1B:
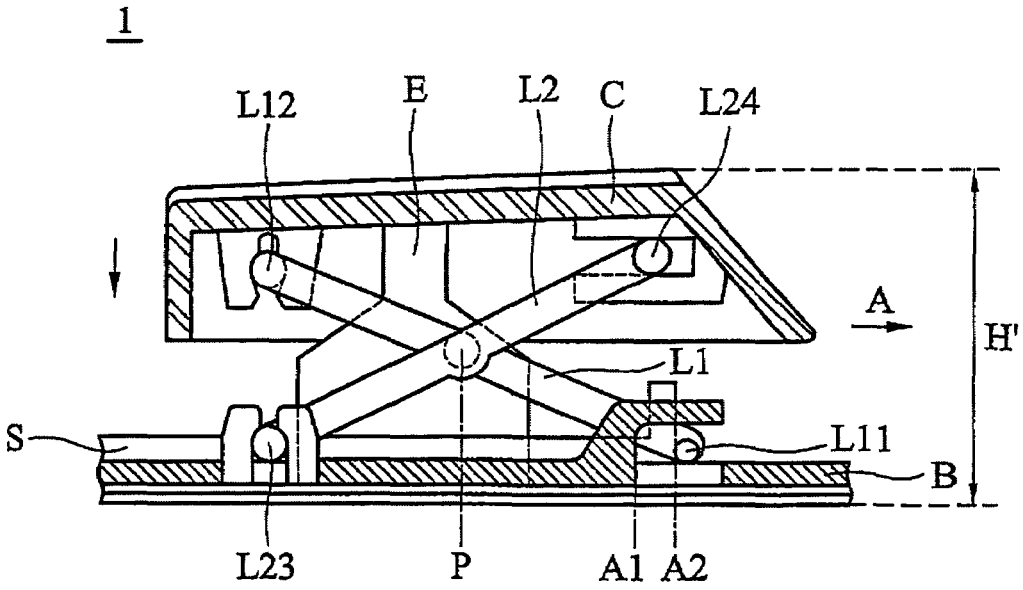
FIG. 1B ( RELATED ART )
Figure 2A:
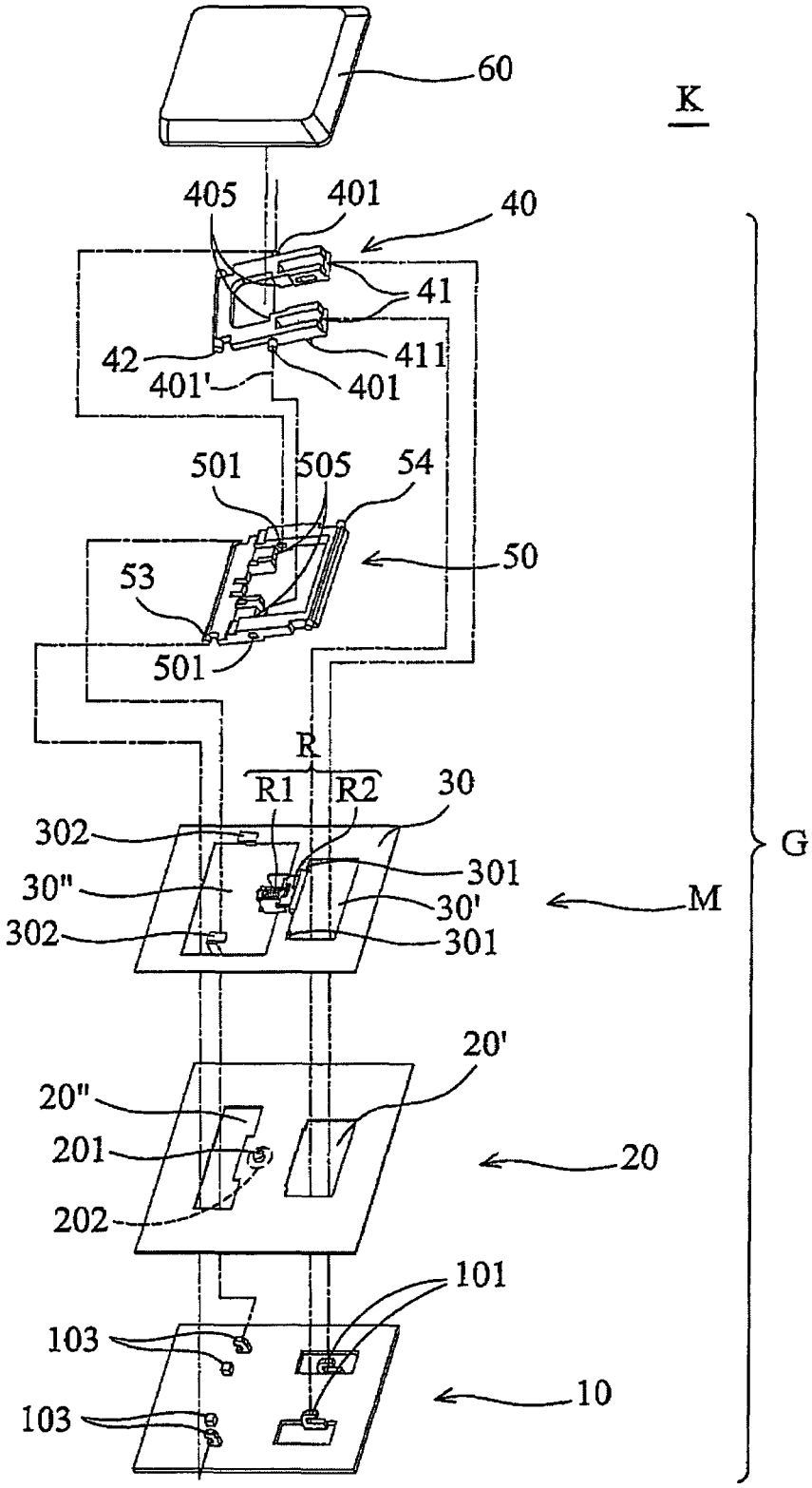
FIG. 2A is an exploded diagram of an embodiment of a key structure.

Referring to FIG. 2A, an embodiment of a key structure primarily comprises a key cap 60 and a resilient mechanism G. The resilient mechanism G comprises a substrate 10, a circuit membrane assembly 20, a movable resilient unit M, a first rod 40, a second rod 50 and a key cap 60, wherein the resilient unit M comprises a resilient element R and a slider 30.

Figure 3A:
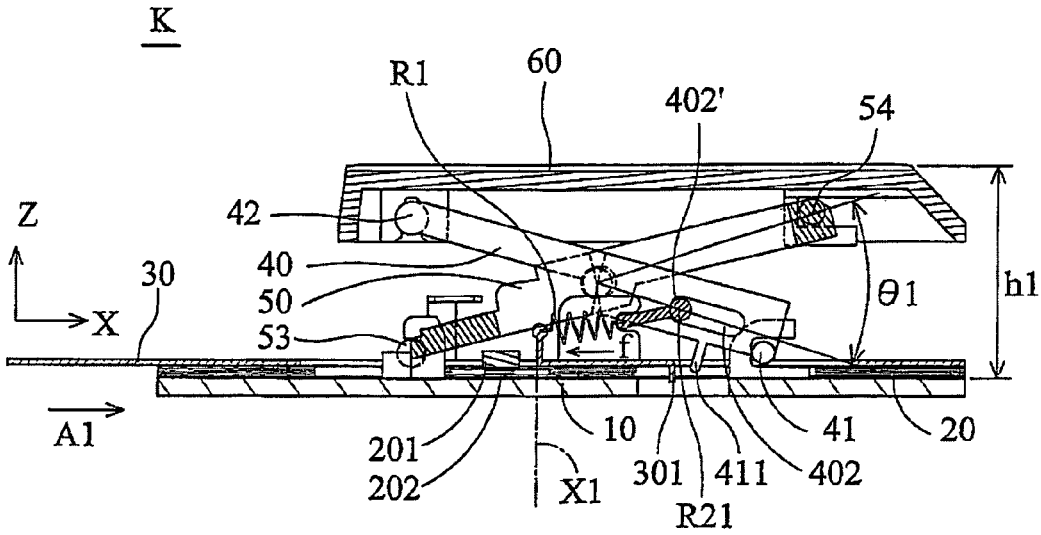
FIG. 3A is a perspective diagram of a key structure in a normal state.

As shown in FIGS. 2A and 3A, the first and second rods 40 and 50 are rotatably connected by a hinge 401 pivotally received in a hole 501, forming a scissoring mechanism. In this embodiment, the first rod 40 has a first end 41 movably connected to a guiding portion 101 on the substrate 10 and a second end 42 pivotally connected to the key cap 60. The second rod 50 has a third end 53 pivotally connected to a pivot portion 103 and a fourth end 54 movably connected to the key cap 60. Specifically, the guiding portion 101 and the pivot portion 103 pass through the openings 20' and 20" of the circuit membrane assembly 20, to connect the first and second rods 40 and 50, respectively.

Figure 2B:
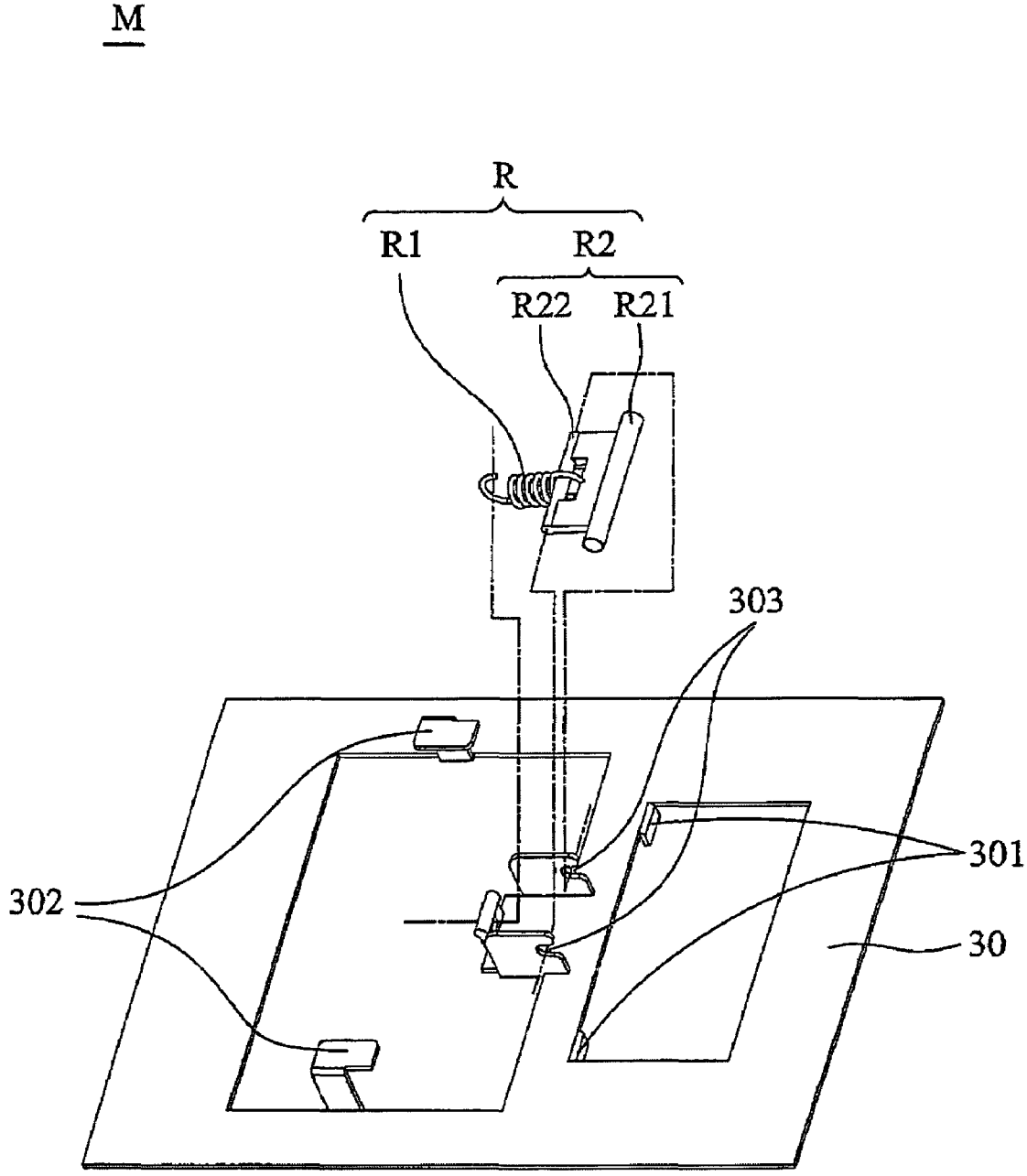
FIG. 2B an exploded diagram of the resilient unit in FIG. 2A.

As shown in FIGS. 2B and 3A, the resilient element R includes connection member R2 and a resilient member R1. The resilient member R1, such as a tension spring, connects the slider 30 and the connection member R2. In FIG. 2B, the slider 30 has a first abutting portion 303, and the connection member R2 has a sliding portion R21 and a second abutting portion R22. The sliding portion R21 movably connects to the first rod 40, and the second abutting portion R22 separably abuts the first abutting portion 303 of the slider 30. Here, the resilient member R1 is extended and have a lateral pre-tension force f.

Referring to FIG. 3A, when the key structure K is in a normal state, the slider 30 is situated in a first position X1, wherein the sliding portion R21 of the connection member R2 is received in a slot 402 of the first rod 40 and substantially abuts an end 402' thereof, such that the first rod 40 is held at an angle with respect to the substrate 10. Hence, the key cap 60 is supported by the first and second rods 40 and 50 at a first height h1 with respect to the substrate 10, wherein the first and second rods 40 and 50 have a first angle θ1.

Figure 3B:
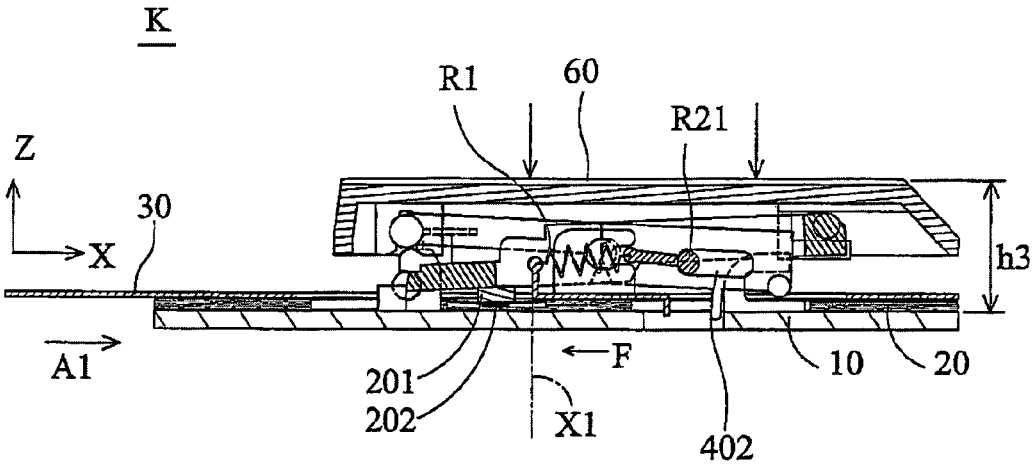
FIG. 3B is a perspective diagram of the key structure in FIG. 3A depressed by an external force.

When the key structure K is in the normal state with the key cap 60 pressed downward by a external force, the key cap 60 descends from the first height h I to a specific height h3, and the first rod 40 moves in a first direction A1, as shown in FIG. 3B. Here, the resilient member R1 is further extended and exerts a recovery force F (F>f) on the first rod 40, wherein the sliding portion R21 continuously abuts the end 402' of the slot 402. When the external force is released, recovery force F from the resilient member R1 returns the key cap 60 to the first height h1, as shown in FIG. 3A.

From the state shown in FIG. 3A to the state shown in FIG. 3B, the tension of the resilient member is progressively increased from pre-tension force f to recovery force F, wherein the ratio of f/F may exceed 10%. However, to provide better tactile feedback, the ratio of f/F may exceed 30%. When the key structure K is in the normal state, the resilient member R1 provides an axial linear spring force, wherein direction and magnitude of the recovery force F stably varies according to height of the sliding portion R21.

In this embodiment, the circuit membrane assembly 20 and the slider 30 are connected and moved together. Referring to FIGS. 2A and 3B, a resilient pad 201 is disposed on a switch 202 of the circuit membrane assembly 20. When the slider 30 is in the first position X1 with the key cap 60 pressed downward to height h3, as shown in FIG. 3B, the second rod 50 pushes the resilient pad 201, such that the switch 202 is actuated and transmits an electronic signal to external circuit via the circuit membrane assembly 20. However, the switch 202 can also be actuated by the first rod 40 or the key cap 60 pushing the resilient pad 201. In some embodiments, the switch 202 can be a component of the circuit membrane assembly 20, however, the switch 202 can also be disposed alone without the circuit membrane assembly 20.

Figure 3C:
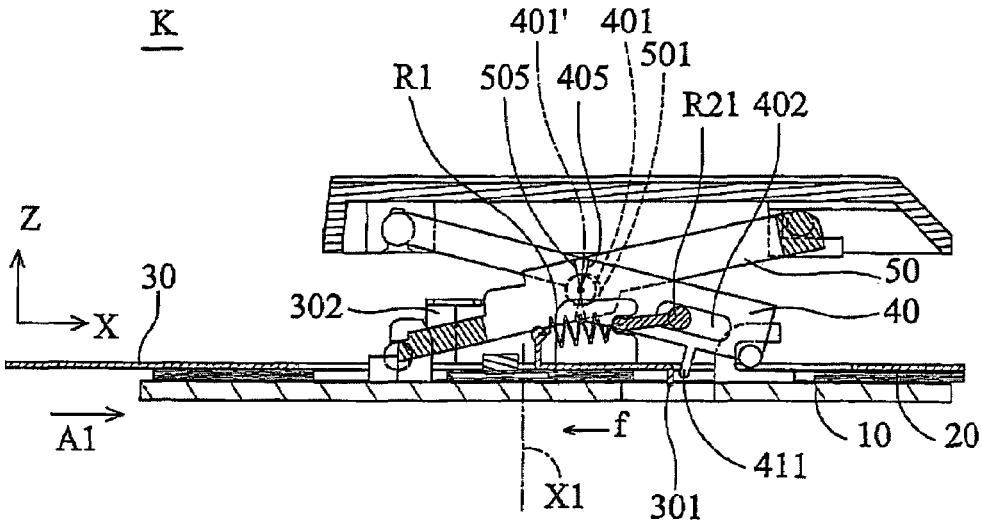
FIG. 3C-3E are perspective diagrams of the key structure in FIG. 3A in transition to a depressed state.
Figure 3D:
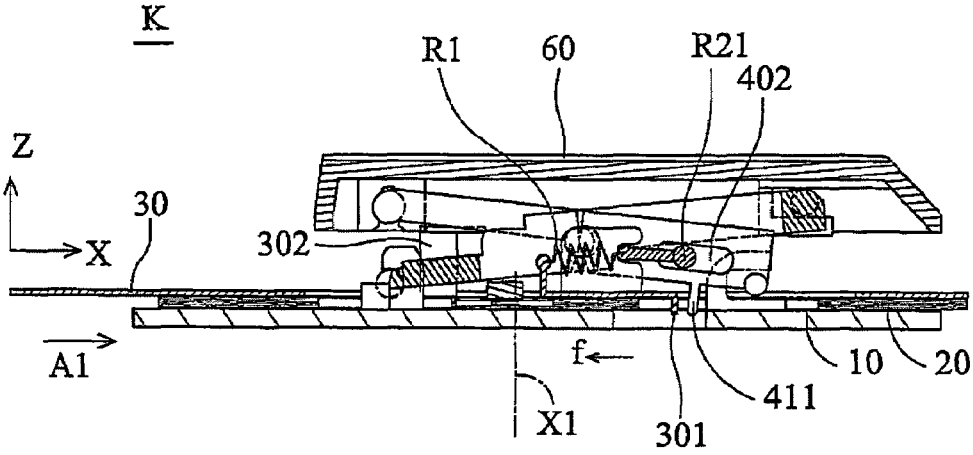
Figure 3E:
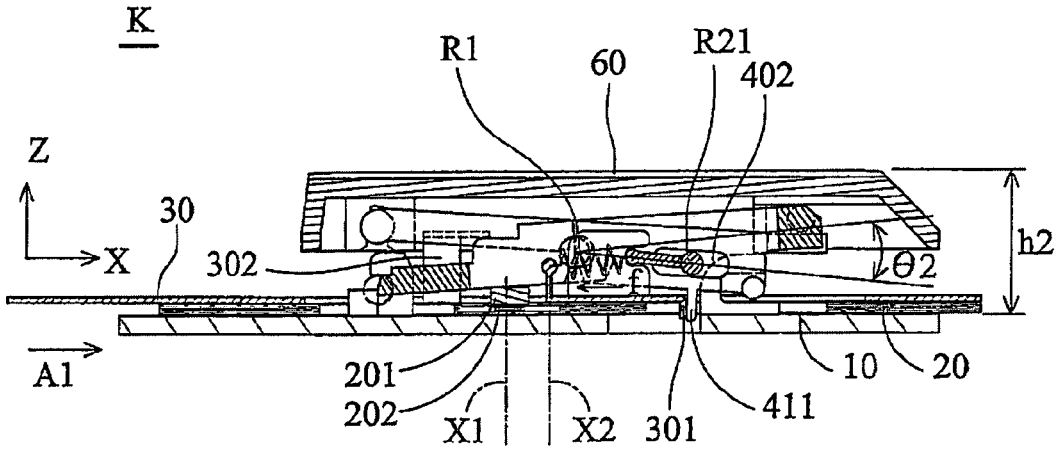

Referring to FIGS. 3C-3E, when the slider 30 moves in the first direction A1 from the first position X1 to a second position X2, the key structure K moves from the normal state shown in FIG. 3A to a depressed state shown in FIG. 3E, wherein the circuit membrane assembly 20 moves with the slider 30. During movement of the slider 30 along the first direction A1 from FIG. 3C to FIG. 3E, the second abutting portion R22 continuously abuts the first abutting portion 303, such that the resilient member R1 remains pre-tensioned. Specifically, since the first rod 40 is released from the resilient member R1, the sliding portion R21 slides along the slot 402 of the first rod 40. Hence, the key cap 60 descends to a second height h2 by gravity or an external force as shown in FIG. 3E, wherein h2<h1. Here, the key structure K is in a depressed state, wherein the first and second rods 40 and 50 form a second angle less than the first angle θ1.

To force the key cap 60 to the second height h2 during movement of slider 30 from the first position X1 to the second position X2, a projection 302 of the slider 30 impels the second rod 50 in the first direction A1, as shown in FIG. 3D, such that the key cap 60 descends toward the substrate 10 to the depressed state. As shown in FIG. 3E, the slider 30 further has a protrusion 301 impelling an extending portion 411 of the first rod 40 when the slider 30 moves to the second position X2, such that the first rod 40 slides along the guiding portion 411, and the key cap 60 is depressed toward the substrate 10.

In this embodiment, the protrusion 301 and the extending portion 411 are separated as shown in FIGS. 3C and 3D, however, they can also continuously contact each other during full movement of the slider 30, to prevent noise from sudden impact thereof. Since the circuit membrane assembly 20 is repositioned with the slider 30 to the second position X2, as the depressed state shown in FIG. 3E, the key cap 60, first and second rods 40 and 50 will not actuate the switch 202 to prevent unexpected contact.

Referring to FIGS. 2A and 3C, a hinge 401 of the first rod 40 is loosely received in a hole 501 of the second rod 50, such that the first and second rods 40 and 50 are pivotally connected. Specifically, the size of the hole 501 is slightly lager than the hinge 401, such that friction during rotation is reduced, to facilitate easy operation. As shown in FIGS. 2A and 3C, the first rod 40 has a first contact portion 405, and correspondingly, the second rod 50 has a second contact portion 505, opposite to the first contact portion 405. The first and second contact portions 405 and 505 rotatably contact each other close to a central axis 401' of the hinge 401. During rotation of the first and second rods 40 and 50, the first and second contact portions 405 and 505 rotate and contact with respect to each other, efficiently reducing lateral spring stress on the hinge 401 from the resilient member R1 and preventing kinetic friction between the first and second rods 40 and 50. In some embodiments, the rotation mechanism of the first and second contact portions 405 and 505 can also be applied to the pivot portion 103 and the third end 53 of the second rod 50.

Figure 4:
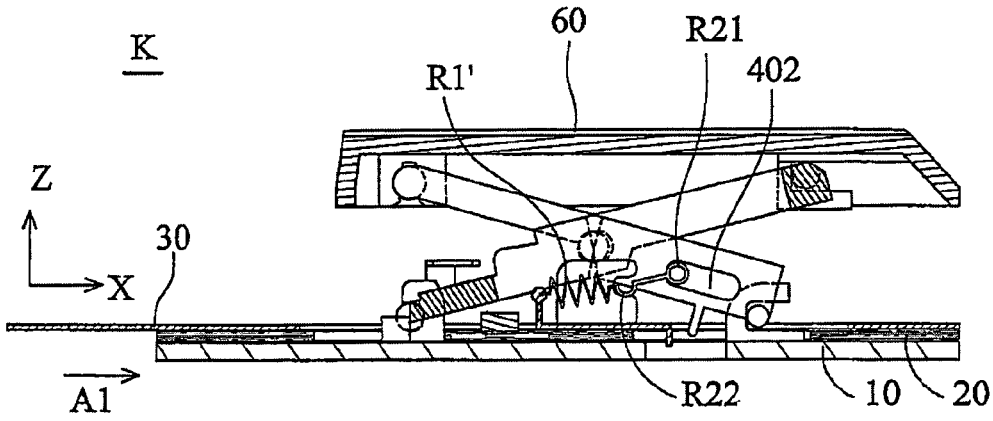
FIG. 4 is a perspective diagram of a key structure having a spring connecting a slider and a first rod.

Rather than the resilient element R in FIG. 2B, the resilient element R can also consist of a single spring R1' as shown in FIG. 4, wherein a curved portion of the spring R1' is formed as the sliding portion R21 or the second abutting portion R22 of the connection member R2 in FIG. 2B, simplifying the key structure K.

According to this embodiment, a key structure K having a resilient unit M is provided, wherein the key cap 60 of the key structure K can be depressed to save space. In some embodiments, the resilient unit M can also be disposed outside the main body of the key structure K, wherein the resilient member R1 can be a compression spring.

Figure 5A:
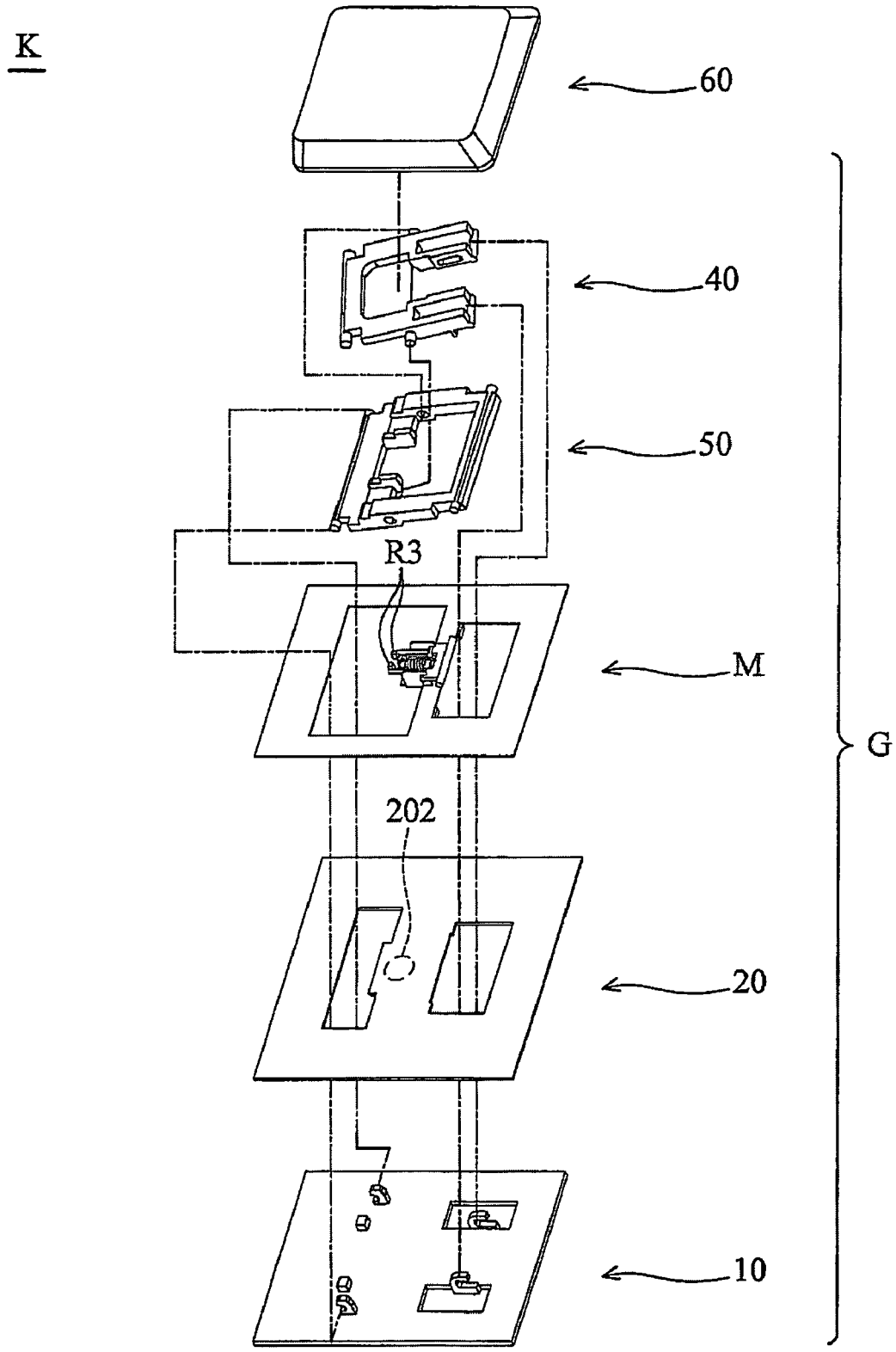
FIG. 5A is an exploded diagram of another embodiment of a key structure.
Figure 5B:
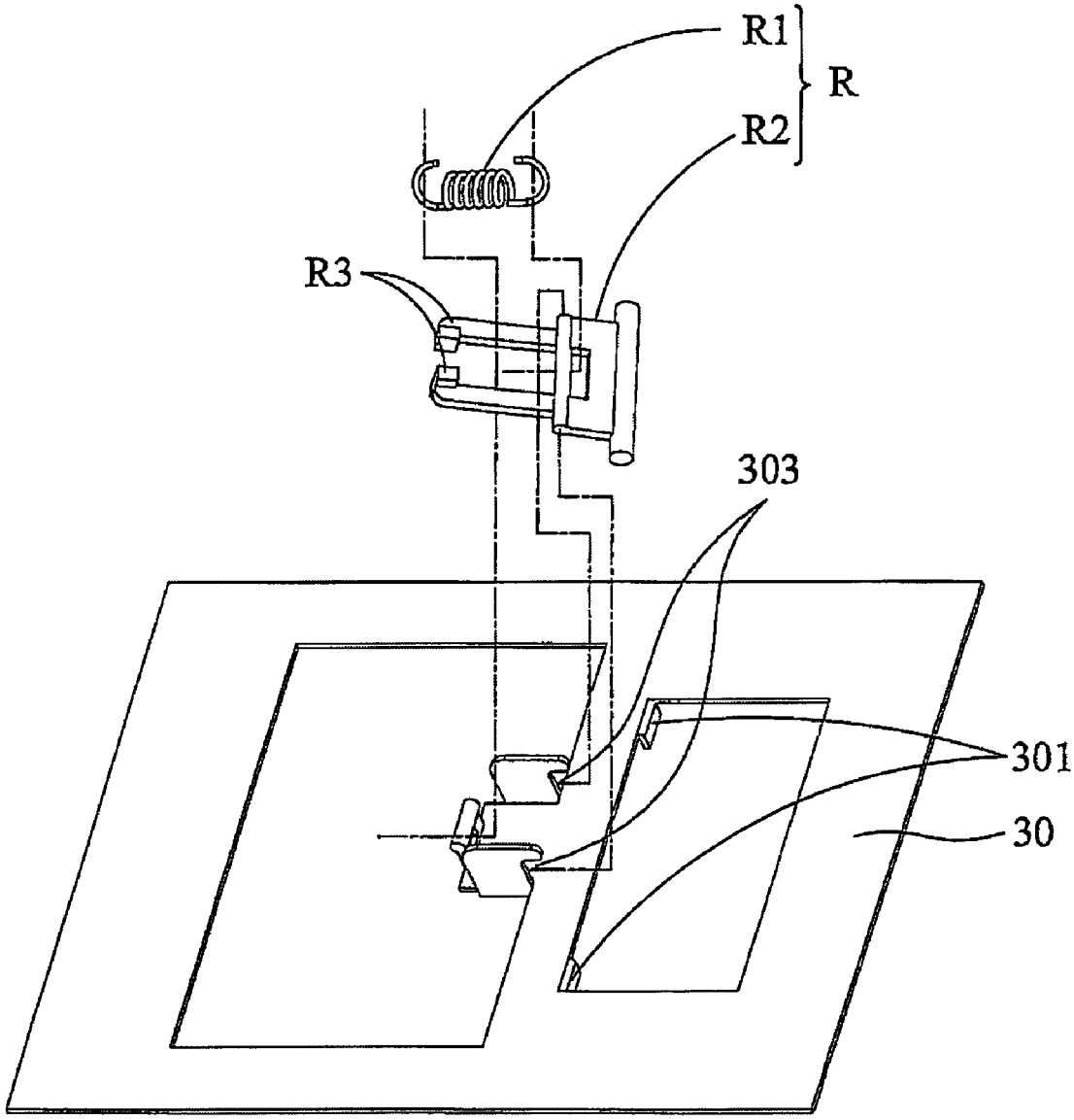
FIG. 5B an exploded diagram of the resilient unit in FIG. 5A.

FIGS. 5A-6D are perspective diagrams of another embodiment of a key structure K. Elements corresponding to those of FIGS. 2A-3E and 5A-6D share the same reference numerals, and explanation thereof is omitted for simplification of the description. Unlike FIGS. 2A-3E, here, the key structure K comprises an arm R3 connected to the connection member R2 of the resilient element R, as shown in FIGS. 5A and 5B. Referring to FIGS. 6A and 6B, when the key structure K is in a normal state with the key cap 60 pressed downward by an external force from a first height h1 to a specific height h3, the first rod 40 moves in a first direction A1, as shown in FIG. 6B, wherein the resilient member R1 is extended and exerts a lateral recovery force F on the first rod 40. When the external force is released, recovery force F from the resilient member R1 returns the key cap 60 to the first height h1, as shown in FIG. 6A. Specifically, when the key cap 60 is pressed downward to the height h3, the first rod 40 pushes the arm R3 as shown in FIG. 6B, actuating the switch 202 on the circuit membrane assembly 20. In some embodiments, the switch 202 can also be actuated by the second rod 50 or the key cap 60 pushing the arm R3.

Figure 6A:
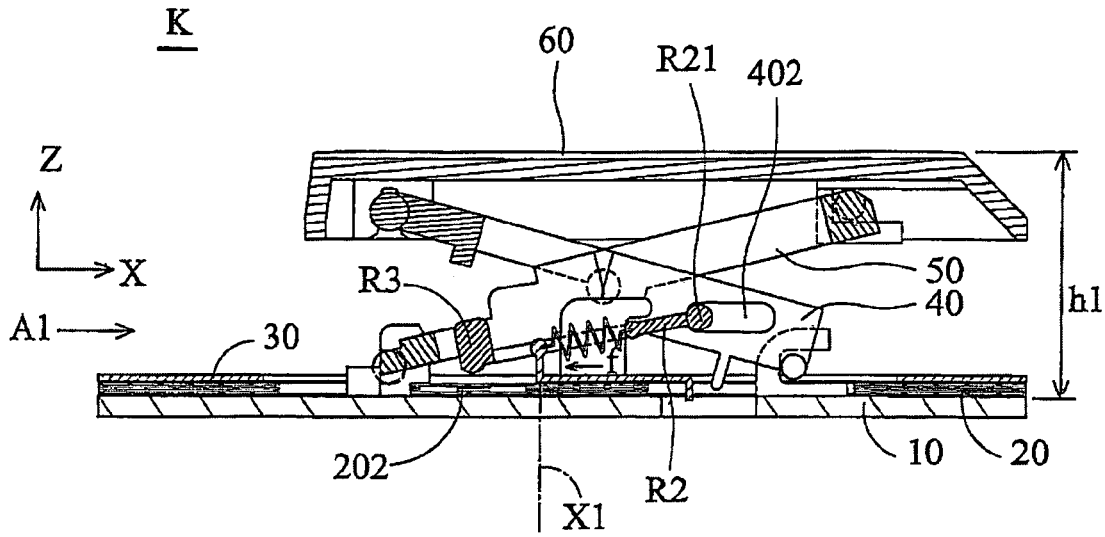
FIG. 6A is a perspective diagram of a key structure in a normal state.
Figure 6B:
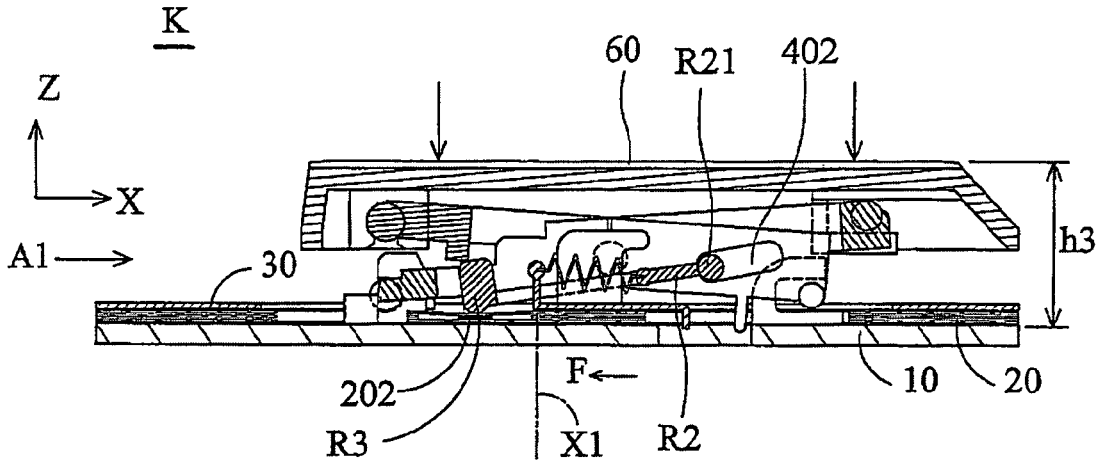
FIG. 6B is a perspective diagram of the key structure in FIG. 6A depressed by an external force.
Figure 6C:
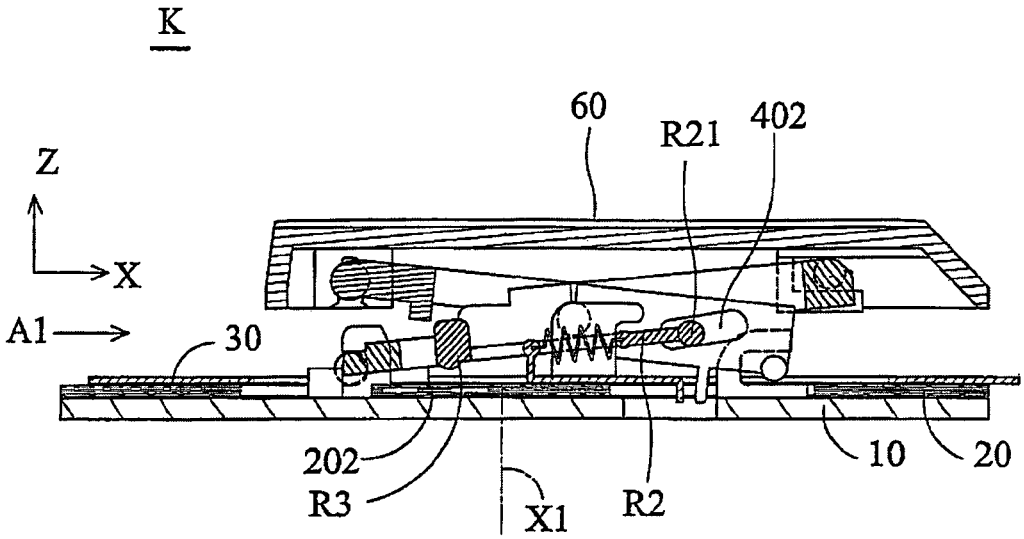
FIG. 6C-6D are perspective diagrams of the key structure in FIG. 6A in transition to a depressed state.
Figure 6D:
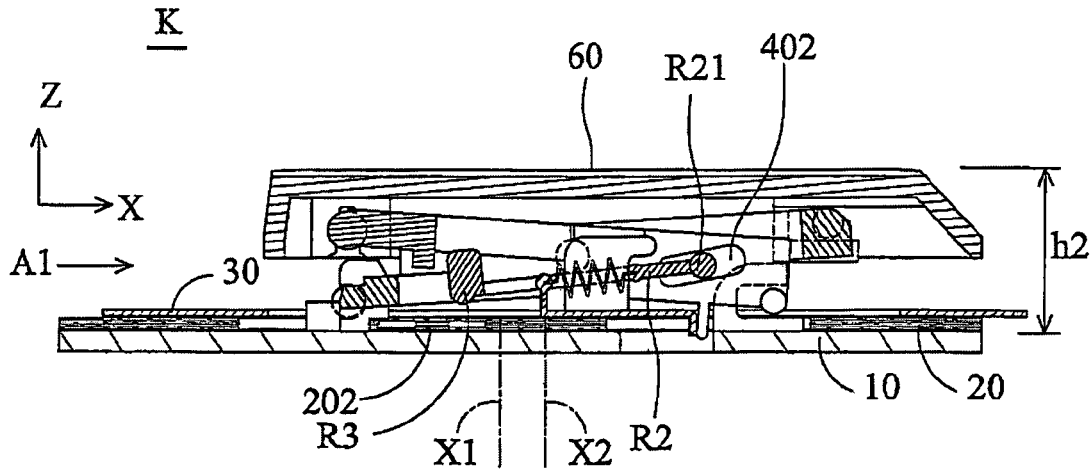

Referring to FIGS. 6C and 6D, when the slider 30 moves in a first direction A1 from a first position X1 to a second position X2, the key structure K moves from the normal state shown in FIG. 6A to a depressed state shown in FIG. 6D, wherein the circuit membrane assembly 20 is fixed to the substrate 10, not moving with the slider 30. During movement of the slider 30 along the first direction A1, the second abutting portion R22 continuously contacts the first abutting portion 303, as shown in FIG. 6C, wherein the sliding portion R21 slides within a slot 402 of the first rod 40. Here, since the first rod 40 is released from spring force, the key cap 60 descends downward to a second height h2 by gravity or an external force, as shown in FIG. 6D. Specifically, since the arm R3 has moved with the slider 30 to the second position X2, the key cap 60, first and second rods 40 and 50 will not actuate the switch 202, to prevent unexpected contact.

Figure 7A:
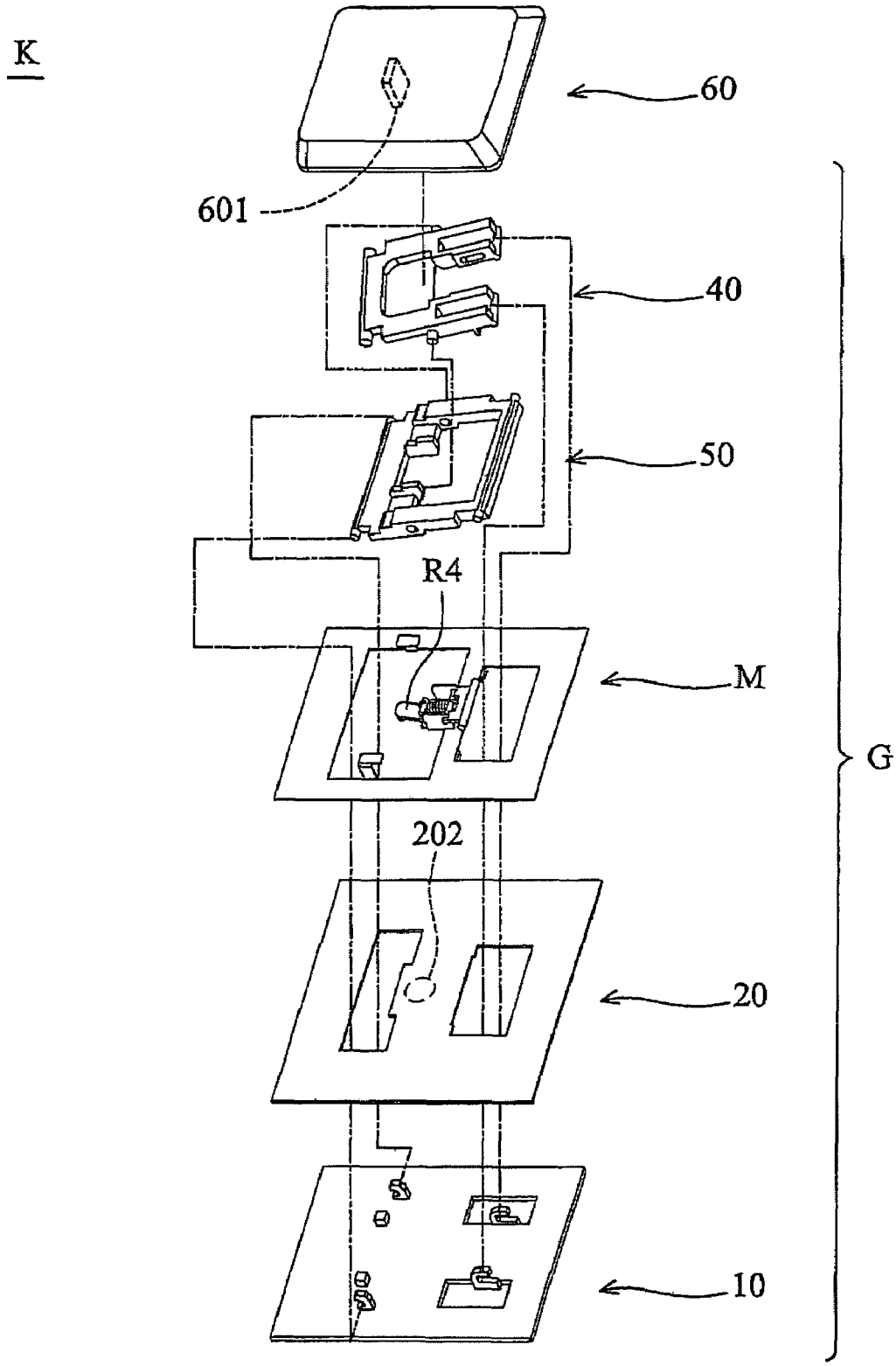
FIG. 7A is an exploded diagram of another embodiment of a key structure.
Figure 7B:
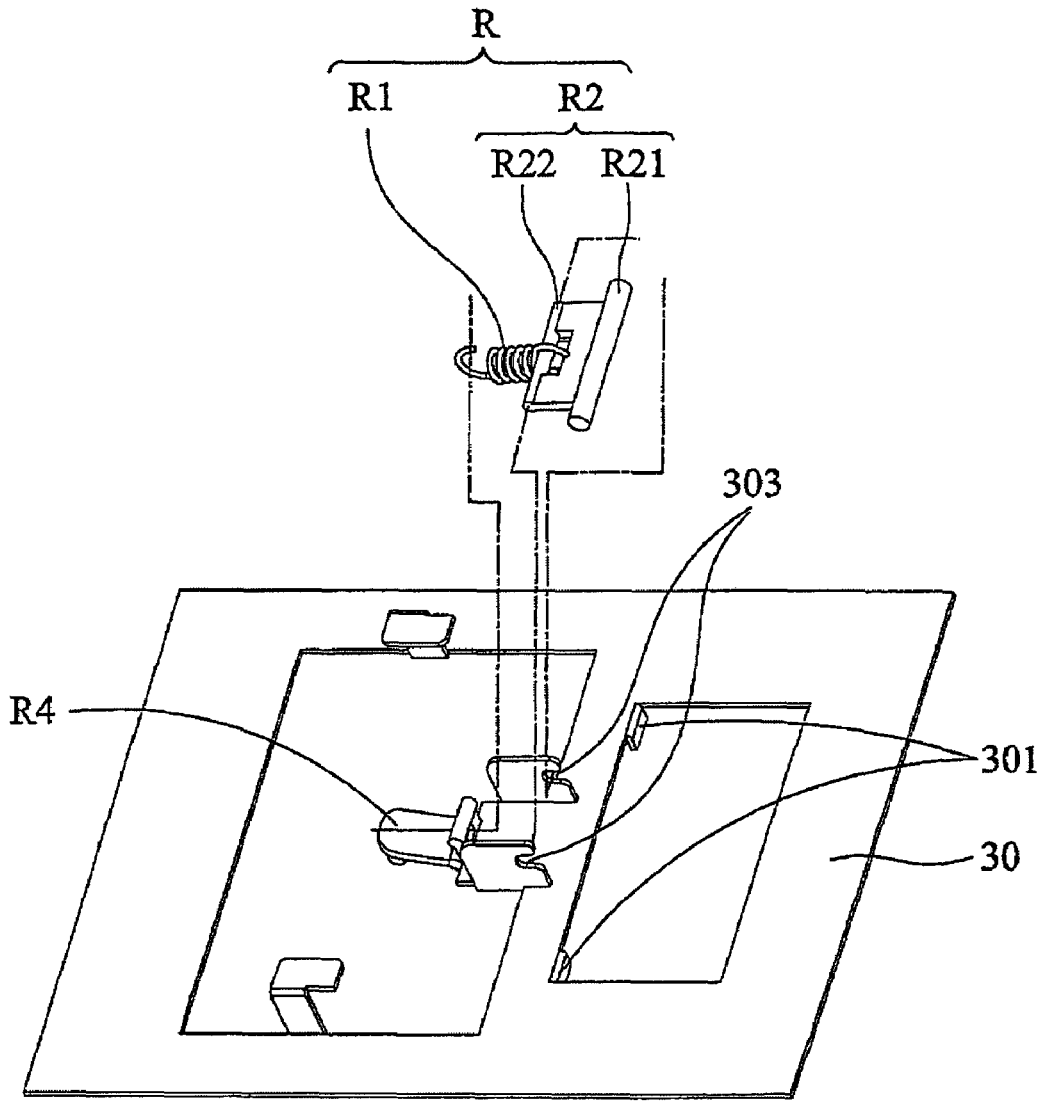
FIG. 7B an exploded diagram of the resilient unit in FIG. 7A.

FIGS. 7A and 7B are perspective diagrams of another embodiment of a key structure K. Elements corresponding to those of FIGS. 7A-8D and 5A-6D share the same reference numerals, and explanation thereof is omitted for simplification of the description. Instead of the arm 30 in 5A and 5B, here, the key structure K comprises an elastic arm R4 connected to the slider 30, as shown in FIGS. 7A and 7B.

Figure 8A:
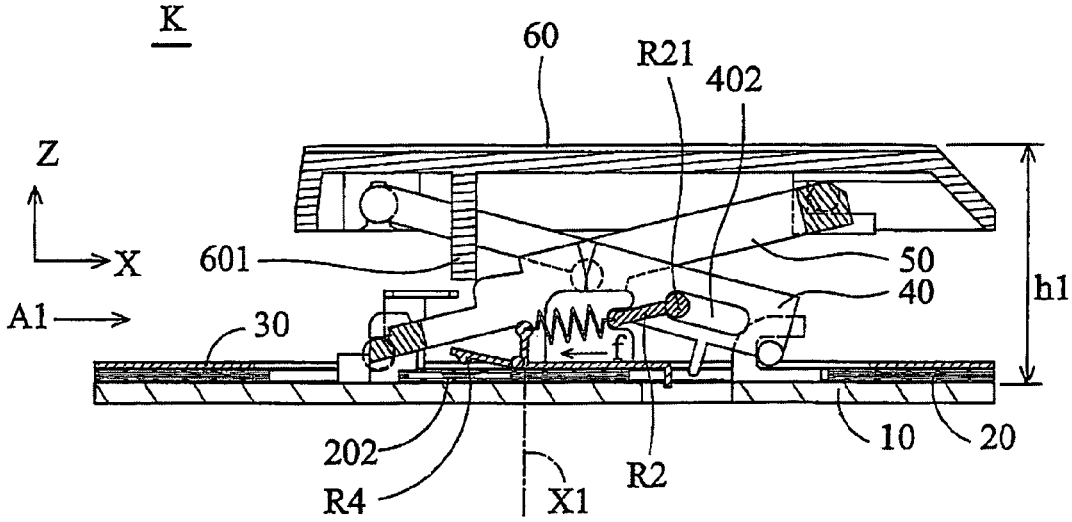
FIG. 8A is a perspective diagram of a key structure in a normal state.
Figure 8B:
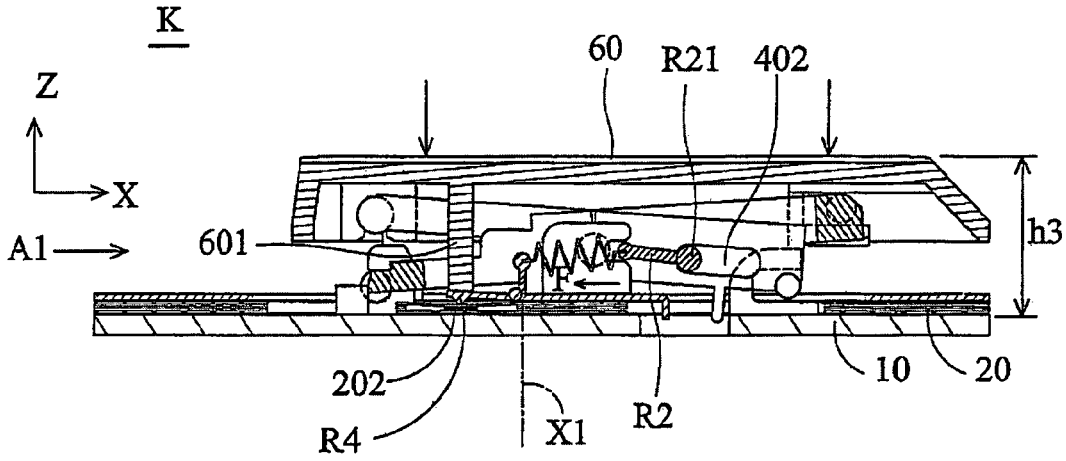
FIG. 8B is a perspective diagram of the key structure in FIG. 8A depressed by an external force.

Referring to FIGS. 8A and 8B, when the key structure K is in a normal state with the key cap 60 pressed downward by an external force from a first height h1 to a specific height h3, the first rod 40 moves along the first direction A1, as shown in FIG. 8B, wherein the resilient member R1 is extended and exerts a lateral recovery fore F on the first rod 40. When the external force is released, recovery force F from the resilient member R1 returns the key cap 60 to the first height h1, as shown in FIG. 8A.

When the key cap 60 is pressed downward to the height h3 as shown in FIG. 8B, a post 601 of the key cap 60 pushes the elastic arm R4, actuating the switch 202 on the circuit membrane assembly 20. However, the switch 202 can also be actuated by the first rod 40 or the second rod 50 pushing the elastic arm R4. In some embodiments, the post 601 can be a resilient structure fixed to the key cap 60, however, the post 601 and the key cap 60 can also be integrally formed in one piece.

Figure 8C:
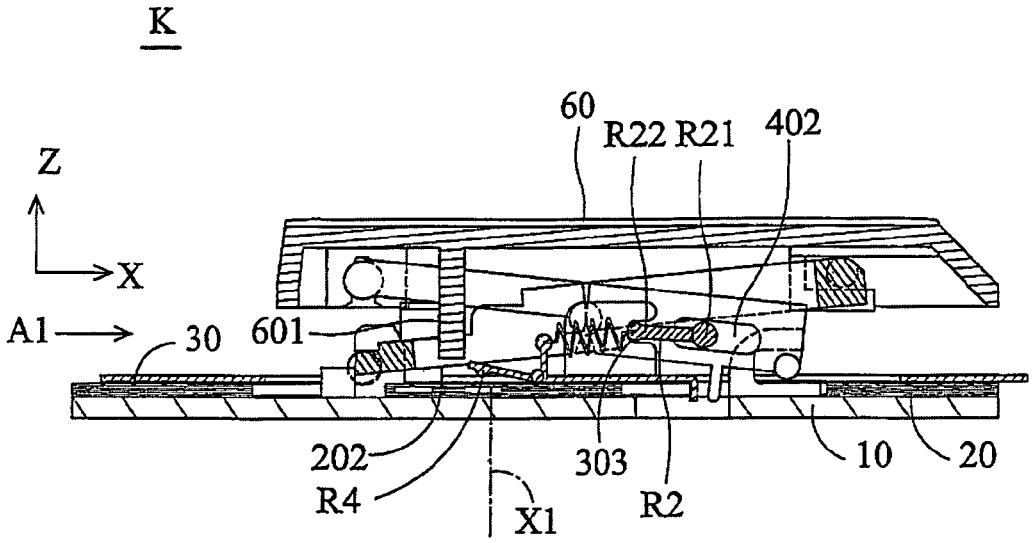
FIG. 8C-8D are perspective diagrams of the key structure in FIG. 8A in transition to a depressed state.
Figure 8D:
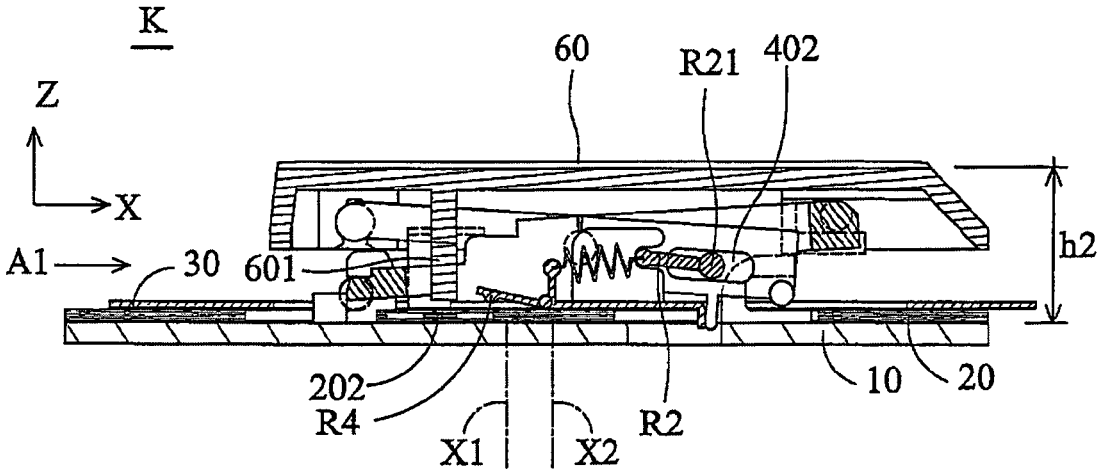

Referring to FIGS. 8C-8D, when the slider 30 moves in a first direction A1 from a first position X1 to a second position X2, the key structure K moves from the normal state shown in FIG. 8A to a depressed state shown in FIG. 8D, wherein the circuit membrane assembly 20 is fixed to the substrate 10, not moving with the slider 30. During movement of the slider 30 along the first direction A1, the second abutting portion R22 continuously contacts the first abutting portion 303, as shown in FIG. 8C, wherein the sliding portion R21 slides in a slot 402 of the first rod 40. Here, since the first rod 40 is released from spring force, the key cap 60 is depressed to a second height h2 by gravity or an external force, as shown in FIG. 8D.

In the depressed state shown in FIG. 8D, since the elastic arm R4 has moved with the slider 30 to the second position X2, the key cap 60, first and second rods 40 and 50 will not actuate the switch 202, to prevent unexpected contact. In some embodiments, the elastic arm R4 can be replaced by the resilient pad 201 shown in FIG. 2A, such as a rubber, wherein the resilient pad 201 may comprise a conductive portion (not shown), being a part of the switch 202.

Figure 9:
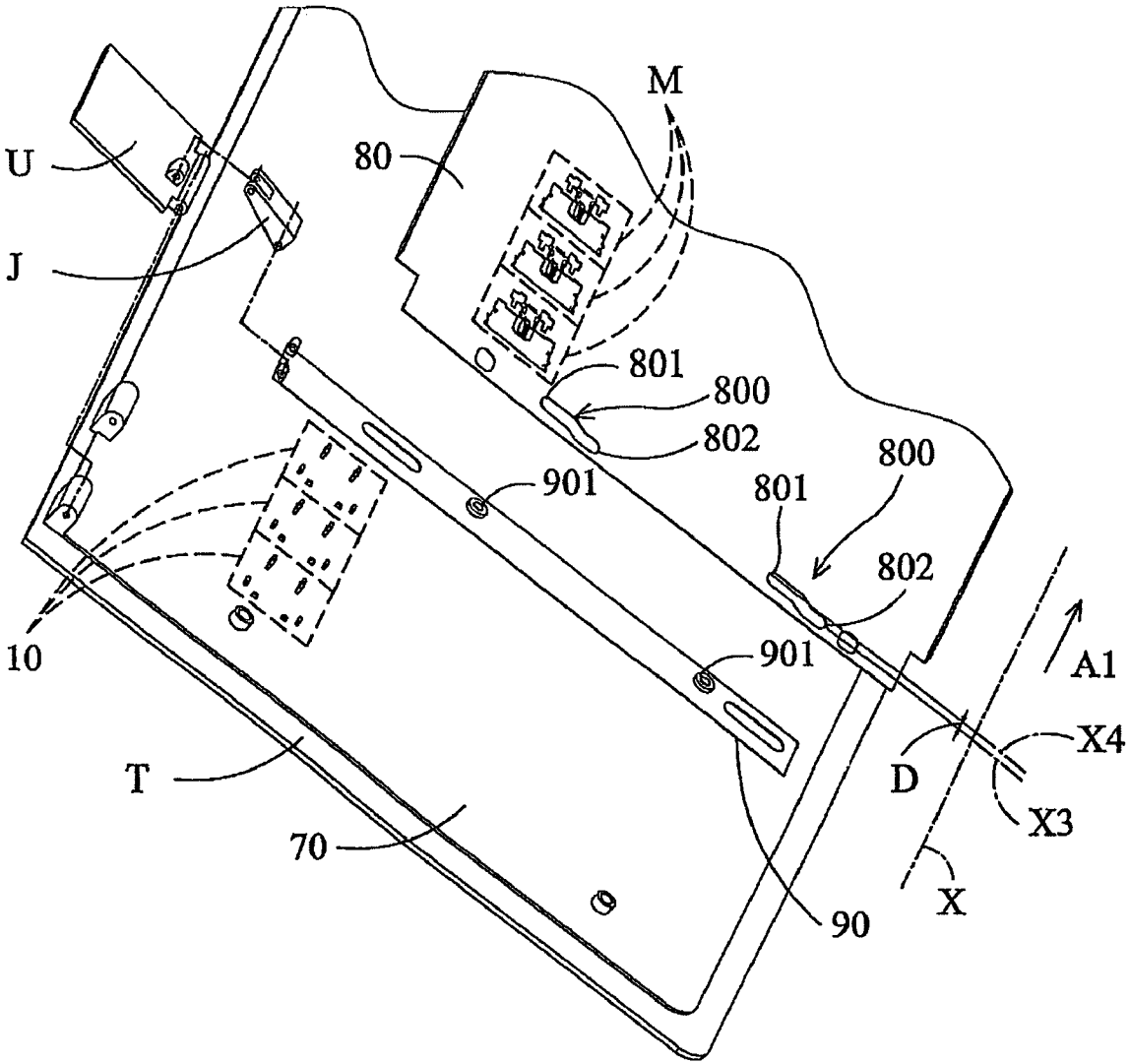
FIG. 9 is an exploded diagram of an embodiment of an input device.

Referring to FIG. 9, the key structure K can be used in an input device, such as a keyboard of a notebook computer. The keyboard primarily comprises a plurality of key structures K, a base module 70, a movable resilient module 80 and a movable plate 90 disposed between the base module 70 and the resilient module 80. Explanation of the key structures K is omitted for simplification of the description.

As shown in FIG. 9, the substrates 10 of the key structures K are disposed on the base module 70, and the resilient mechanisms M of the key structures K are disposed on the resilient module 80. Specifically, the resilient module 80 is moved between a third position X3 and a fourth position X4, switching the key structures K between a normal state and a depressed state, respectively.

In this embodiment, the resilient module 80 has at least a Z-shaped guiding channel 800, wherein both ends 801 and 802 of the guiding channel 800 communicate and have an offset distance D therebetween along X axis. The plate 90 is movable perpendicular to X axis, comprising at least a guiding block 901 corresponding to the guiding channel 800. Specifically, the guiding block 901 passes through the guiding channel 800 and is movable between the ends 801 and 802 thereof. When the guiding block 901 is at the end 801, the resilient module 80 is in the third position X3. When the guiding block 901 is in the end 802, the resilient module 80 is in the fourth position X4.

Referring to FIGS. 10A, 10B, 11A and 11B, an embodiment of the input device further comprises a cover U, a frame T with the base module 70 fixed thereto, and a pivot member J pivotally connecting the frame T and the plate 90. The cover U, such as a display housing of a notebook computer, pivotally connects the frame T or the base module 70, such that the input device is collapsible between an open state and a closed state.

Figure 10A:
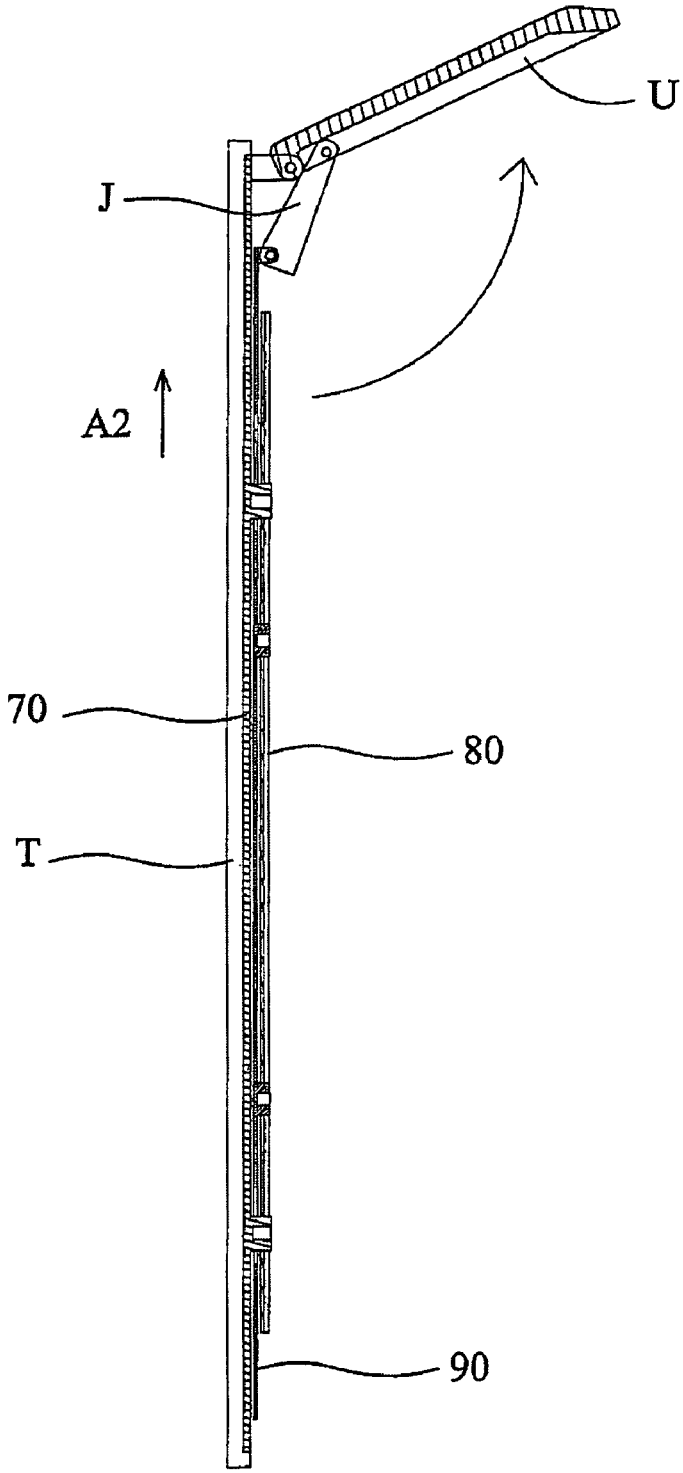
FIG. 10A-10B are perspective diagrams of an input device in a closed state.
Figure 10B:
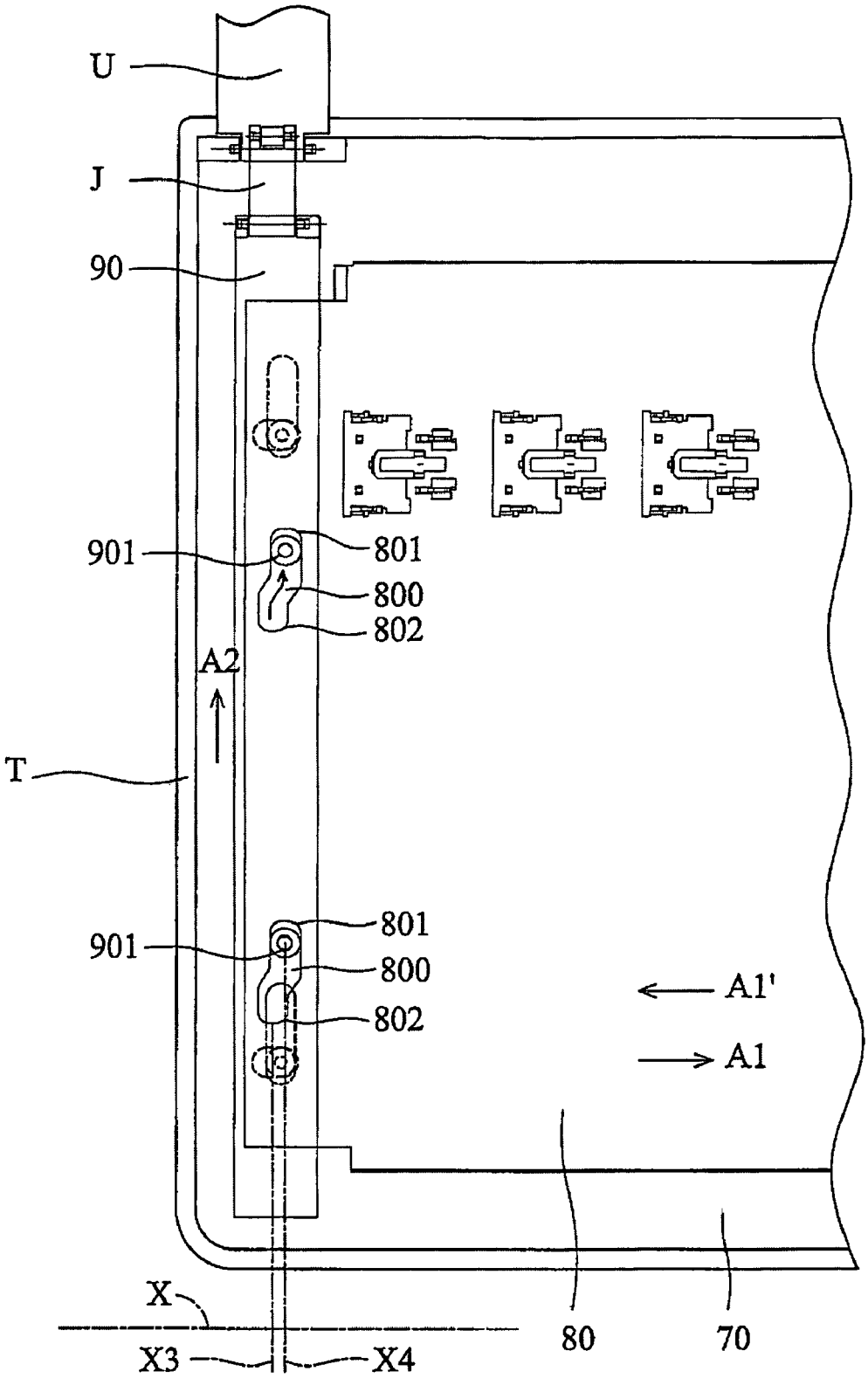
Figure 11A:
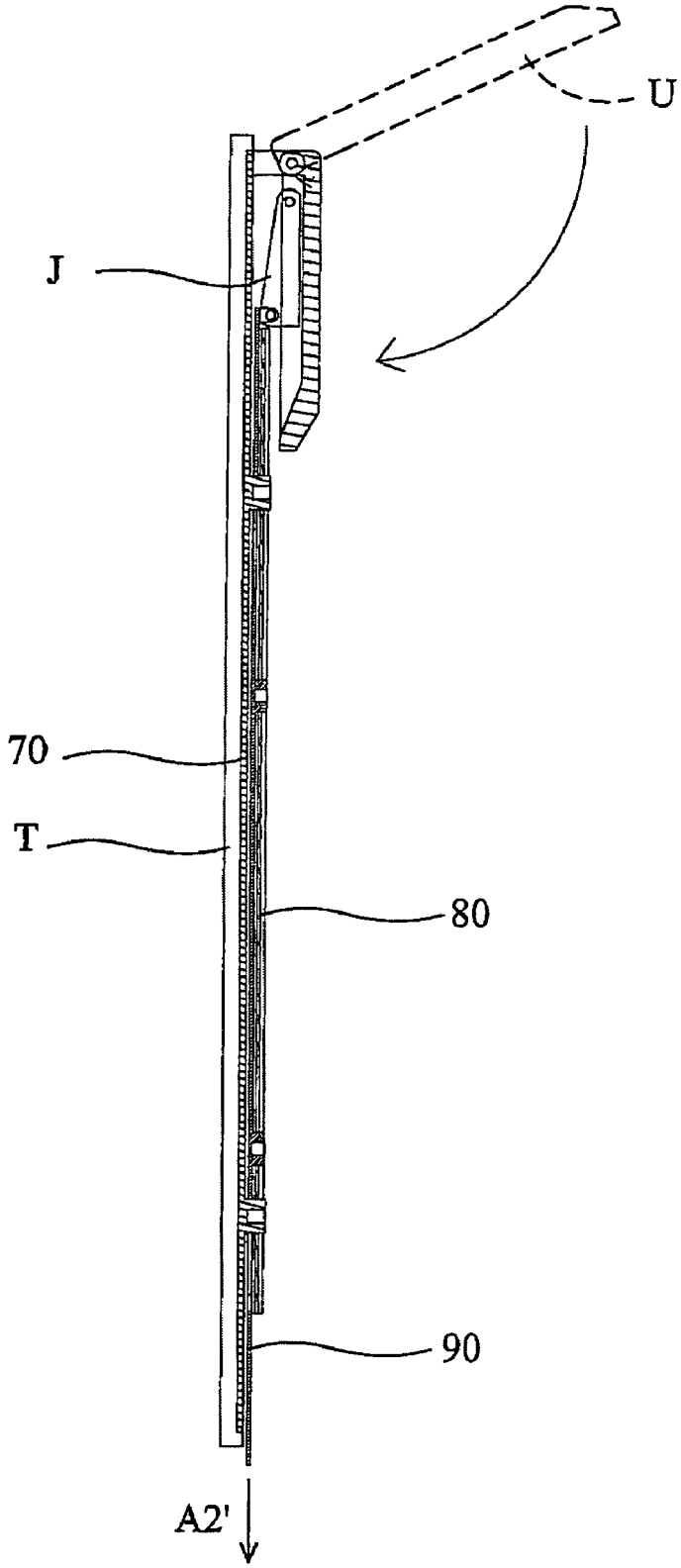
FIG. 11A-11B are perspective diagrams of an input device in a closed state.
Figure 11B:
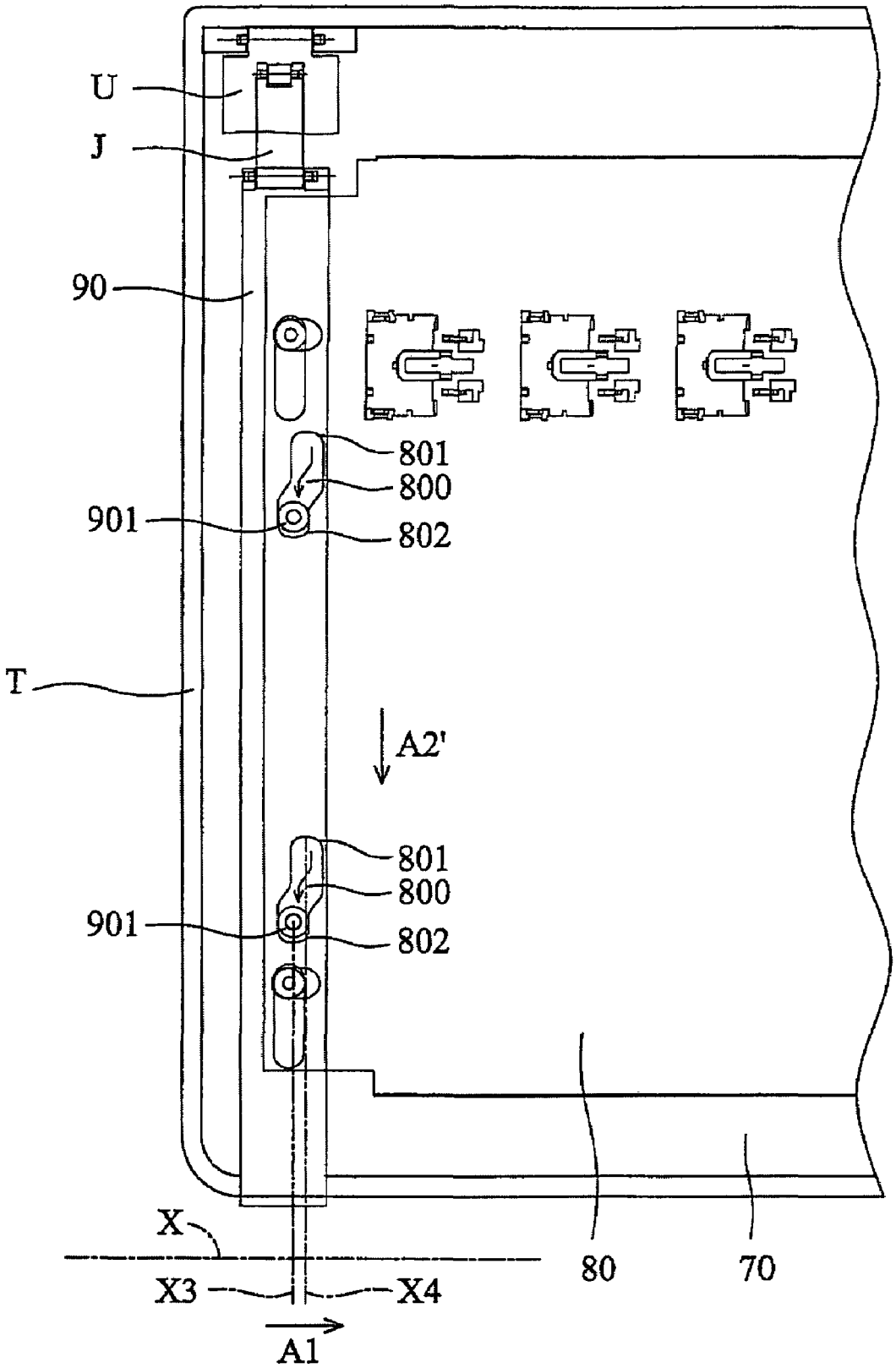

When the input device is opened from the closed state shown in FIGS. 11A and 11B to the open state shown in FIGS. 10A and 10B, the cover U rotates and impels the plate 90 moving in a second direction A2 (perpendicular to the first direction A1) via the pivot member J. Here, the guiding block 901 moves to the end 801 of the guiding channel 800, and the resilient module 80 moves to the third position X3 along the direction A1' (opposite to the first direction A1), such that the key structures K are raised to the normal state.

On the contrary, when the input device is closed from the open state to the closed state, as shown in FIGS. 11A and 11B, the cover U is collapsed toward the frame T and the base module 70. Here, the pivot member J pushes the plate 90 along the direction A2' (opposite to the second direction A2), and the guiding block 901 moves from the end 801 to the end 802 of the guiding channel 800, such that the resilient module 80 moves from the third position X3 to the fourth position X4 along the first direction A1, moving the key structures K to the depressed state. In some embodiments, a motor or electromagnetic device is provided to reposition the plate 90 or the resilient module 80, moving the key structures K between the normal and depressed states.

Figure 12A:
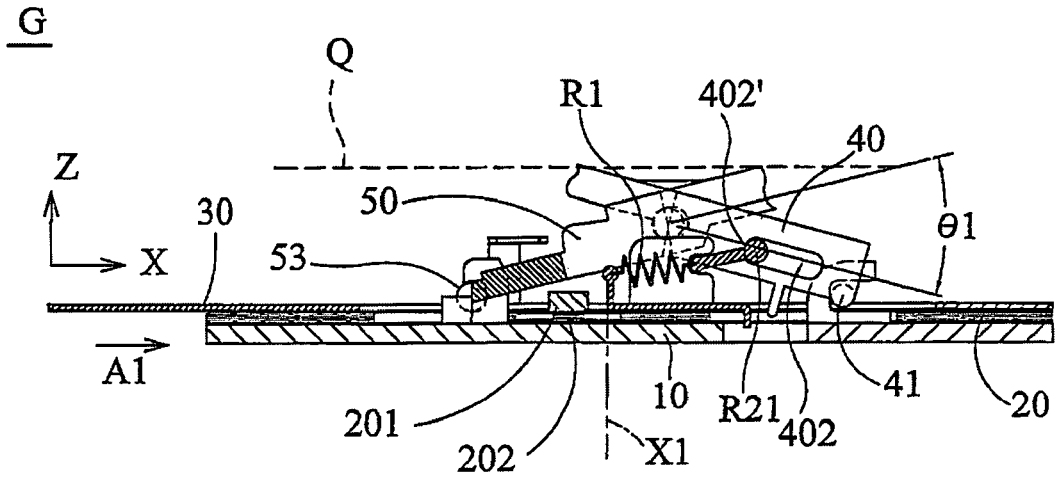
FIG. 12A is a perspective diagram of an embodiment of a resilient mechanism in a normal state.
Figure 12B:
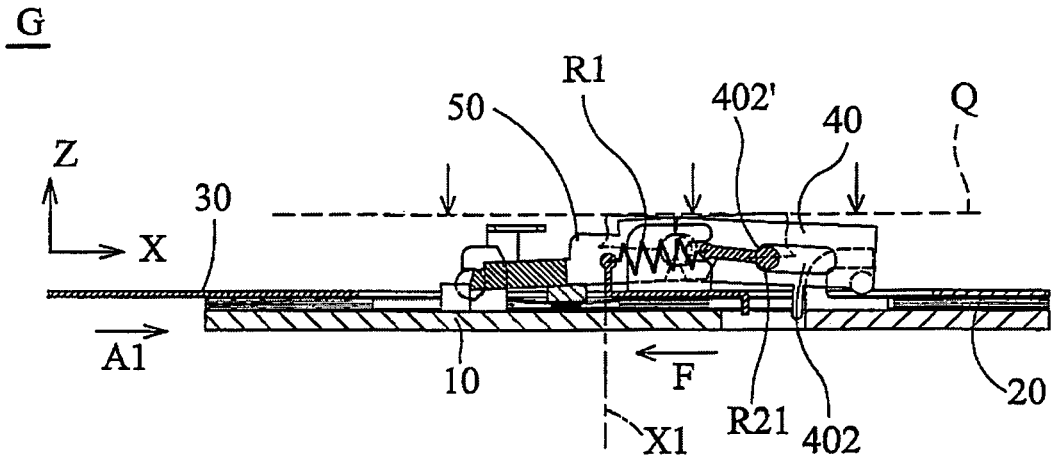
FIG. 12B is a perspective diagram of the resilient mechanism in FIG. 12A depressed by an external force.
Figure 12C:
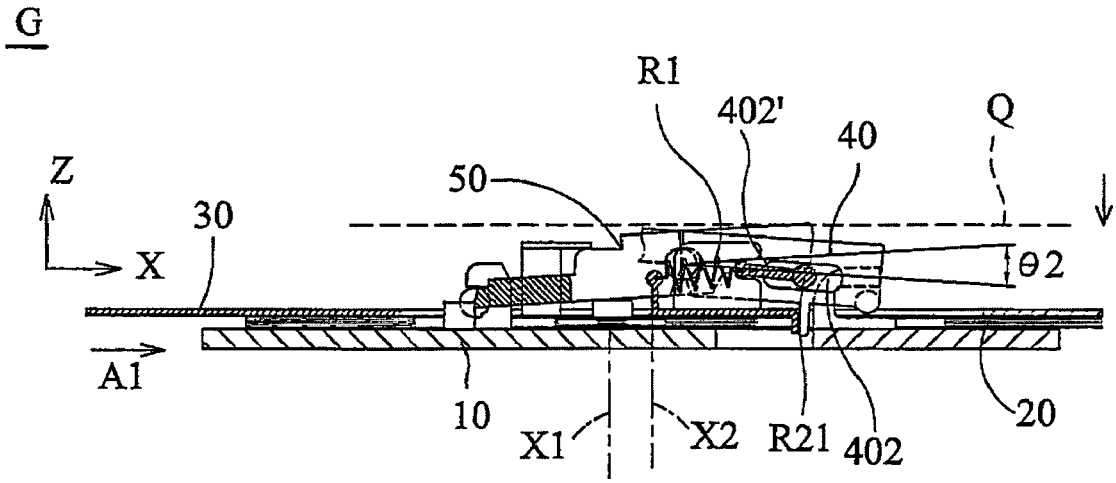
FIG. 12C is a perspective diagram of the resilient mechanism in FIG. 12A in a depressed state.

Referring to FIGS. 12A-12C, a resilient mechanism G is provided for a key structure corresponding to the embodiment shown in FIGS. 2A-3E, wherein the key cap 60 is omitted from FIGS. 12A-12C. Elements corresponding to those of FIGS. 2A-3E and 12A-12C share the same reference numerals, and explanation thereof is omitted for simplification of the description.

In FIGS. 12A-12C, the resilient mechanism G is movably or pivotally connected to a surface Q, such as a surface of a key cap (not shown), wherein the resilient mechanism G exerts an elastic force on the surface Q. Specifically, the resilient unit M of the resilient mechanism G, as shown in FIGS. 2A-3E, is movable between a first position X1 and a second position X2.

When the resilient unit M is in the first position X1, the resilient mechanism G is in a normal state, wherein the resilient unit M abuts the first rod 40, and the first and second rods 40 and 50 form an first angle θ1, as shown in FIG. 12A. When the resilient mechanism G is pressed downward to the state shown in FIG. 12B, the resilient mechanism G exerts an elastic recovery force F on the surface Q, such as a surface of a key cap.

As shown in FIG. 12C, when the resilient unit M moves to the second position X2, the first rod 40 is released from the resilient unit M, such that the first and second rods 40 and 50 descend downward by gravity or an external force. Here, the resilient mechanism G is in a depressed state and exerts no force on the surface Q, wherein the first and second rods 40 and 50 form an second angle θ2 (θ2<θ1).

Figure 13A:
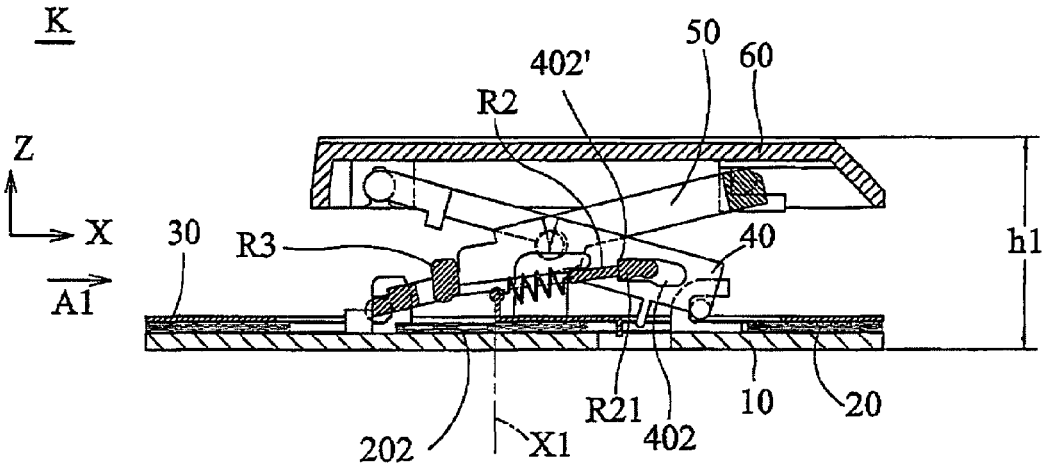
FIG. 13A is a perspective diagram of another embodiment of a key structure in a normal state.
Figure 13B:
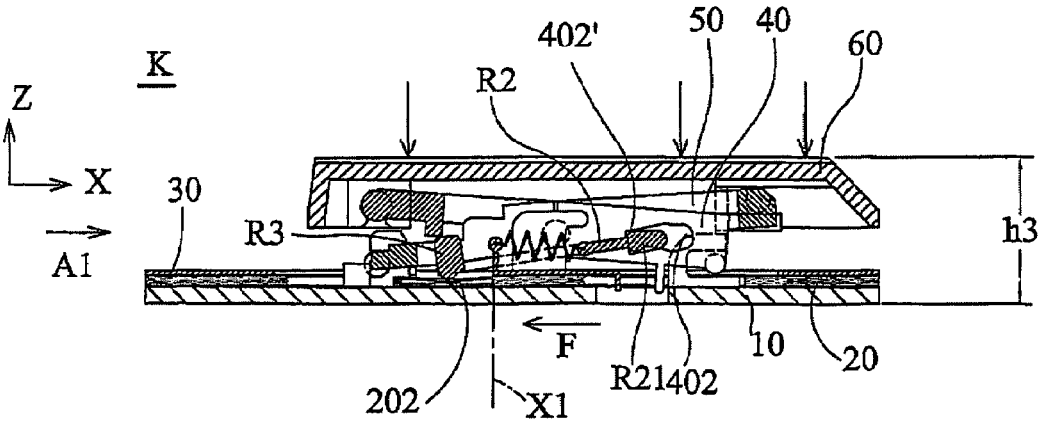
FIG. 13B is a perspective diagram of the key structure in FIG. 13A depressed by an external force.

Another embodiment of a key structure K is provided according to FIGS. 13A-13D. Elements corresponding to those of FIGS. 5A-6D and 13A-13D share the same reference numerals, and explanation thereof is omitted for simplification of the description. Unlike FIGS. 5A-6D, the slot 402 of the first rod 40 in FIG. 13A is tapered, comprising a narrow end 402' and a wide end opposite thereto, wherein the sliding portion R21 abuts the narrow end 402' when the key structure K is in a normal state, as shown in FIGS. 13A and 13B. Specifically, profile of the sliding portion R21 is corresponding to that of the slot 402.

Figure 13C:
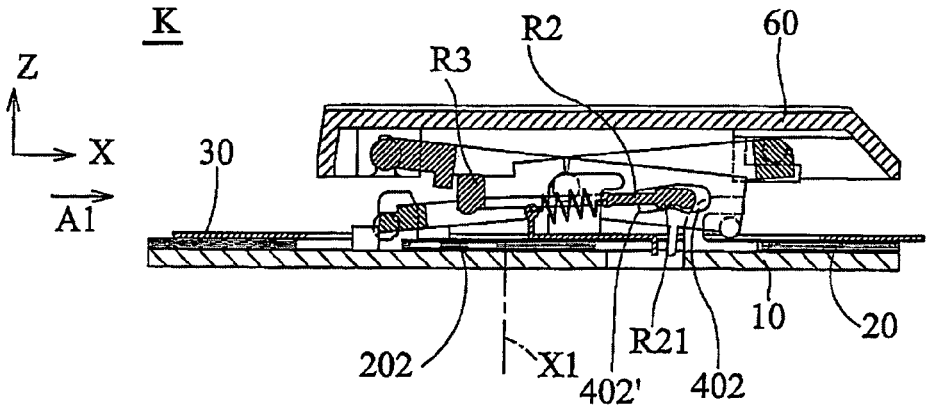
FIG. 13C-13D are perspective diagrams of the key structure in FIG. 13A in transition to a depressed state.
Figure 13D:
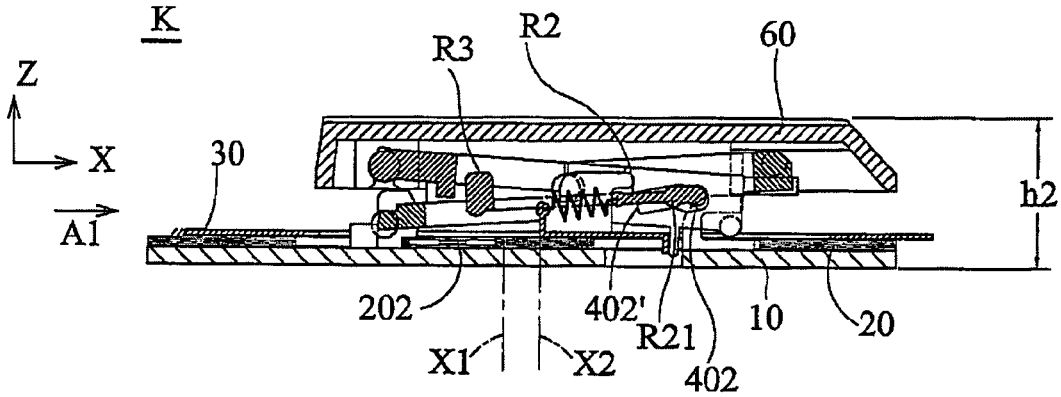

As shown in FIG. 13B, when the key cap 60 is pressed downward, the arm R3 sways and actuates the switch 202. Referring to FIGS. 13C and 13D, when the resilient unit M moves along the first direction A1, the sliding portion R21 slides from the narrow end 402' to the wide end opposite thereto, such that sway angle of the arm R3 is varied, to prevent the switch 202 from unexpected actuation. In some embodiments, profile of the sliding portion R21 corresponds to that of the narrow end 402', to appropriately vary sway margin of the arm R3.

Referring to FIG. 2A, the movable resilient unit M can also be a fixed to the substrate 10, such that the key structure is only used in normal state. In some embodiments, the resilient element R consists of merely the resilient member R1 connecting the first rod 40 and the substrate, to provide a lateral recovery force to the key cap 60, wherein the resilient member R1 can be a coiled tension spring or other springs, such as a leaf spring rather than the coiled spring for saving space.

In some embodiments, two substrates 10 are provided with the circuit membrane assembly 20 disposed therebetween, forming a sandwich structure, such as the key structure disclosed in TW patent application No. 088208239.

Input devices and key structures thereof having resilient mechanisms are provided according to the embodiments. The key structures can descend to a depressed state for space reduction. Moreover, the resilient mechanism can provide a lateral recovery force to return the key cap when in a normal state, simplifying operation.

While the invention has been described by way of example and in terms of the preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A key structure, comprising:

a key cap;

a substrate;

a first rod, having a first end movably connected to the substrate and a second end connected to the key cap;

a second rod connected to the first rod, having a third end connected to the substrate and a fourth end connected to the key cap; and a resilient unit movable between a first position and a second position;

wherein when the resilient unit is in the first position, the resilient unit substantially abuts the first rod to hold the key cap at a first height with respect to the substrate, such that the key structure is in a normal state, and when the resilient unit is in the second position, the first rod is released from the resilient unit, and the key cap descends to a second height lower than the first height by gravity or an external force, such that the key structure is in a depressed state; and wherein the resilient unit comprises a resilient element and a slider movable between the first and second positions, the resilient element comprising a connection member movably connecting to the first rod and a resilient member connecting the slider and the connection member.

2. The key structure as claimed in claim 1, wherein the resilient unit abuts the first rod along a first direction when in the first position.

3. The key structure as claimed in claim 1, wherein the first and second rods form a scissoring mechanism.

4. The key structure as claimed in claim 1, wherein the first and second rods are pivotally connected.

5. The key structure as claimed in claim 1, wherein the resilient element comprises a spring.

6. The key structure as claimed in claim 1, wherein the first rod further has a slot, and the connection member has a sliding portion moving in the slot when the resilient unit moves from the first position to the second position.

7. The key structure as claimed in claim 1, wherein the slider has a first abutting portion, and the connection member has a second abutting portion contacting the first abutting portion when the key structure is in the depressed state, such that the resilient element is pre-tensioned.

8. The key structure as claimed in claim 7, wherein when the key structure is in the normal state with the key cap pressed downward by an external force, the sliding portion of the connection member continuously abuts the first rod.

9. The key structure as claimed in claim 8, further comprising a switch movable with the resilient unit, wherein when the resilient unit is in the first position with the key cap pressed toward the substrate, the key cap, the first rod or the second rod contacts the switch, and when the resilient unit moves to the second position, the key cap, the first rod and the second rod are separated from the switch.

10. The key structure as claimed in claim 9, further comprising a resilient pad disposed on the switch, wherein the switch is actuated by the external force applied to the resilient structure.

11. The key structure as claimed in claim 9, further comprising a circuit membrane assembly with the switch disposed thereon.

12. The key structure as claimed in claim 8, further comprising a switch disposed on the substrate and an arm disposed on the connection member, wherein the arm actuates the switch when the resilient unit is in the first position with the key cap pressed toward the substrate, and the arm separates from the switch when the resilient unit moves to the second position.

13. The key structure as claimed in claim 1, wherein the substrate comprises a guiding portion with the first rod sliding therein.

14. The key structure as claimed in claim 1, wherein the resilient unit comprises a projection impelling the second rod when the resilient unit moves from the first position to the second position, such that the key cap descends toward the substrate to the second height.

15. A key structure, comprising:

a key cap;

a substrate;

a first rod, having a first end movably connected to the substrate and a second end connected to the key cap;

a second rod connected to the first rod, having a third end connected to the substrate and a fourth end connected to the key cap; and a resilient unit movable between a first position and a second position;

wherein when the resilient unit is in the first position, the resilient unit substantially abuts the first rod to hold the key cap at a first height with respect to the substrate, such that the key structure is in a normal state, and when the resilient unit is in the second position, the first rod is released from the resilient unit, and the key cap descends to a second height lower than the first height by gravity or an external force, such that the key structure is in a depressed state;

wherein the resilient unit comprises a slider and a resilient element connected thereto, the slider is movable between the first and second positions, and the resilient element movably connects to the first rod; and wherein the slider has a first abutting portion, and the resilient element has a second abutting portion contacting the first abutting portion when the key structure is in the depressed state, such that the resilient element is pre-tensioned.

16. The key structure as claimed in claim 15, wherein the resilient element comprises a spring.

17. The key structure as claimed in claim 16, wherein the second abutting portion is a curved portion of the spring.

18. The key structure as claimed in claim 15, wherein the slider comprises a protrusion impelling the first rod when the slider moves from the first position to the second position, such that the key cap descends toward the substrate to the second height.

19. The key structure as claimed in claim 18, wherein the first rod further has an extending portion impelled by the protrusion, such that the key cap descends toward the substrate to the second height.

* * * * *